US006983710B1

(12) United States Patent
Shen et al.

(10) Patent No.: US 6,983,710 B1
(45) Date of Patent: Jan. 10, 2006

(54) HIGH SPEED BRAKING OF SUBMERGED PROPELLED SEA CRAFT

(75) Inventors: Young T. Shen, Potomac, MD (US); Robert J. Etter, Sykesville, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 35 days.

(21) Appl. No.: 10/985,070

(22) Filed: Nov. 5, 2004

(51) Int. Cl.
*B63H 25/44* (2006.01)

(52) U.S. Cl. ..... 114/145 R

(58) Field of Classification Search ..... 114/145 R, 114/146, 312, 330; 440/1, 2
See application file for complete search history.

(56) References Cited

U.S. PATENT DOCUMENTS 285,835 A * 10/1883 Otis ..... 114/145 R
1,395,580 A * 11/1921 Jonezic ..... 114/145 R
2,006,515 A * 7/1935 Semmes ..... 244/235
3,133,520 A * 5/1964 Bentkowsky et al. ... 114/144 R

FOREIGN PATENT DOCUMENTS

JP 2-155898 * 6/1990

OTHER PUBLICATIONS

U.S. Nonprovisional Appl. No. 10/781,957 filed Feb. 20, 2004 entitled "Maneuvering of Submerged Propelled Sea Craft".

* cited by examiner

*Primary Examiner*—Ed Swinehart
(74) *Attorney, Agent, or Firm*—Jacob Shuster

(57) ABSTRACT

Forward underwater movement of a sea craft at a high speed induced by propulsion thereof is decelerated and stopped by projection of drag devices, mounted on a fully submerged underwater sea craft hull, from retracted positions within said sea craft hull or the steering rudders positioned thereon. Each of the drag devices has an elongated drag plate with an end surface cap flush with the outer surface of the hull or the steering rudder in the retracted position of the drag device.

7 Claims, 2 Drawing Sheets

HIGH SPEED BRAKING OF SUBMERGED PROPELLED SEA CRAFT

STATEMENT OF GOVERNMENT INTEREST

The invention described herein may be manufactured and used by or for the Government of the United States of America for governmental purposes without the payment of any royalties thereon or therefore.

The present invention relates to deceleration and stopping of submerged propelled sea craft.

BACKGROUND OF THE INVENTION

The maneuvering and stopping of submerged sea craft including waterjet propelled and conventional propeller driven submarines heretofore involved diversion of jet outflow from its propulsion unit or reversal of propeller rotation. It is therefore an important object of the present invention to improve travel stoppage of such sea craft without adverse impact on its propulsion unit.

SUMMARY OF THE INVENTION

In accordance with the present invention, when propulsion of a fully submerged sea craft at a high speed is terminated, forward movement of the sea craft may then be decelerated and stopped by projection of drag plates from retracted positions within the sea craft hull or the steering rudders on the stern end portion of the hull. In such retracted positions, outer surfaces on the drag plates are flush with the outer surface of the hull or the steering rudders.

BRIEF DESCRIPTION OF THE DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
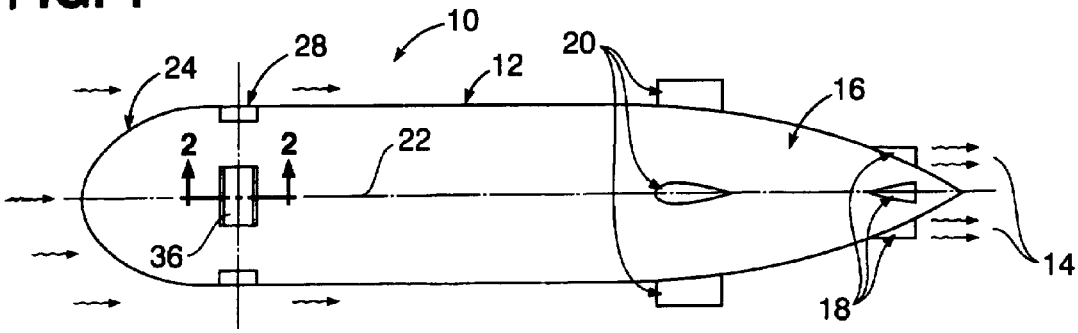
FIG. 1 is a side elevation view of a jet propelled sea craft with braking devices pursuant to one embodiment the present invention.

Referring now to the drawing in detail, FIG. 1 illustrates an underwater submerged sea craft 10 having an axis-symmetric shaped hull 12 according to one embodiment. The sea craft 10 is propelled in a forward direction by emergence of propelling water jets 14 from a conical stern end portion 16 of the hull 12 as generally known in the art. The propelling jets 14 emerge from any number of main water outflow nozzles 18 such as four. Accordingly to one embodiment, conventional rudders 20 are mounted on and project from the hull 12 at locations thereon along a hull centerline 22, closer to the stern end portion 16 than a forward bow end portion 24 onto which seawater flow 26 impinges during propelled travel of the sea craft 10.

Figure 2:
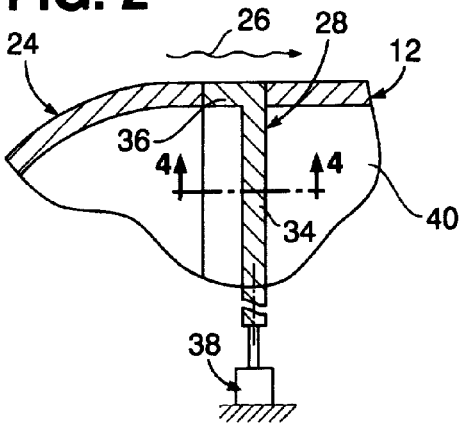
FIG. 2 is a partial section view taken substantially through a plane indicated by section line 2—2 in FIG. 1.
Figure 2A:
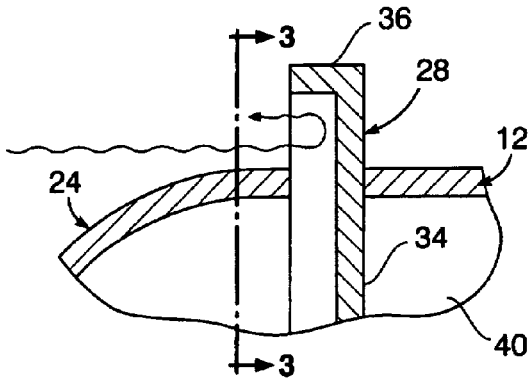
FIG. 2A is a partial section view corresponding to that of FIG. 2, showing projection of a braking device from the retracted position shown in FIG. 2.
Figure 3:
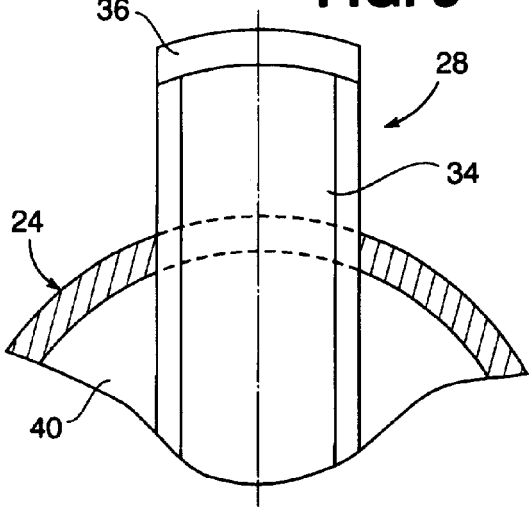
FIG. 3 is a partial section view taken substantially through a plane indicated by section line 3—3 in FIG. 2A.
Figure 4:
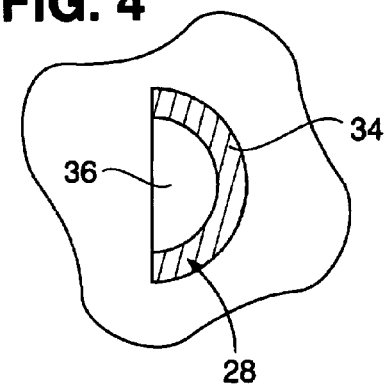
FIG. 4 is a partial section view taken substantially through a plane indicted by section line 4—4 in FIG. 2.

Pursuant to the embodiment of the present invention as shown in FIG. 1, four (4) high speed flow drag braking devices 28 are positioned on the bow end portion 24 of the hull 12 in angularly spaced relation to each other. Each of the braking devices 28 as illustrated in FIGS. 2, 3 and 4 includes an elongated arcuate drag plate 34 that is projected from the hull 12. An end cap 36 at the radially outer end of the drag plate 34 is positioned with its outer surface flush with the outer surface of the hull 12 at the bow end portion 24 in a retracted position of the braking device 28 as shown in FIGS. 1 and 2. Each of the braking devices 28 is projected from its retracted position to an extended position as shown in FIGS. 2A and 3 by an actuator 38 connected thereto inside of a ballast tank chamber 40 enclosed within the hull 12.

Figure 5:
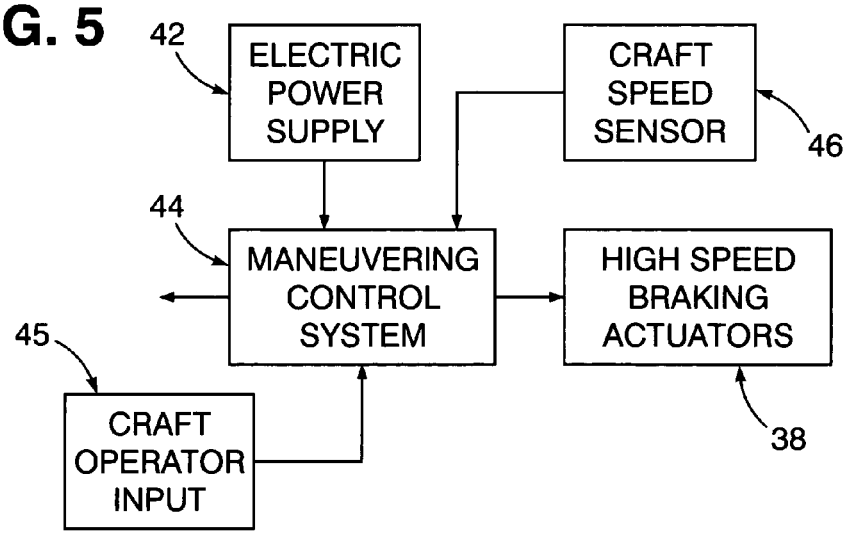
FIG. 5 is a block diagram illustrating operational controls associated with the braking devices shown in FIGS. 1, 2, 2A, 3 and 4.

Projection of the drag plates 34 from the hull 12 is effected for emergency deceleration and stopping of the craft 10 by flow drag during forward travel under high speed conditions. Toward that end an electric power supply 42 within the sea craft 10, as diagramed in FIG. 5, is connected to a maneuvering control system 44 through which the drag plate actuators 38 are operated in response to input of signals from a craft operator 45 and a craft speed sensor 46. Accordingly, pursuant to one embodiment of the present invention the sea craft 10 under travel propulsion is decelerated and then stopped by the extension of the drag devices 28 from their retracted positions under selective control after termination of propulsion.

Figure 6:
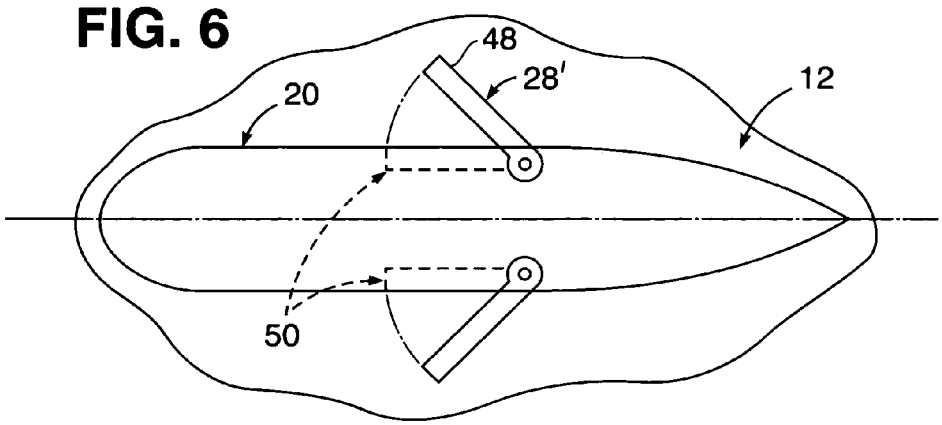
FIG. 6 is a partial top plan view of a stern end portion of a sea craft having a rudder from which braking devices are projected according to another embodiment of the present invention.
Figure 7:
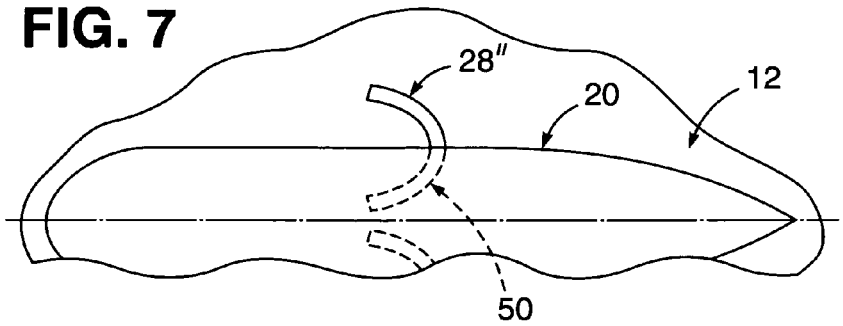
FIG. 7 is a partial top plan view corresponding to that of FIG. 6, showing a braking device projected from the rudder according to yet another embodiment.

According to other embodiments of the present invention, the braking devices 28 as hereinbefore described are replaced by braking devices 28' that are projected laterally from the rudders 20 as shown in FIG. 6 or some other type of directional controls. Such braking devices 28' extended from the rudders 20 are plates pivoted to the lateral sides of the rudders 20, with outer plate surfaces 48 flush with the rudder sides in their retracted positioned within slots 50 formed in the rudders 20. In FIG. 7, yet another embodiment is shown wherein braking devices 28" extended laterally from the rudders 20 are arcuate shaped plates slidably retracted into arcuate slots 50' within the rudders 20.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a fully submerged sea craft having an elongated hull with forward bow and a stern end portions, steering rudders, propelling means mounted on the stern end portion of the hull for imparting forward underwater movement to the sea craft, a maneuvering control system connected to the steering rudders for steerage controlling displacement thereof during said forward movement of the sea craft, and braking means mounted on the hull for imposing drag on the sea craft during said forward movement thereof under high speed conditions, comprising: a plurality of drag devices; and actuator means under control of the maneuvering control system for projection of the drag devices from retracted positions to decelerate and stop said forward movement of the sea craft.

2. The combination as defined in claim 1, wherein each of said drag devices comprises: a drag plate slidably mounted in the hull midway between the forward bow and stern end portions; and an end cap connected to the drag plate having an outer surface flush with the hull in the retracted position of the drag device.

3. The combination as defined in claim 2, including craft operator input and speed sensor means operatively connected to the maneuvering control system for controlling said projection of the drag devices from the hull by the actuator means.

4. The combination as defined in claim 1, including craft operator input and speed sensor means operatively connected to the maneuvering control system for controlling said projection of the drag devices from the sea craft hull by the actuator means.

5. The combination as defined in claim 2, wherein said end cap is arcuate shaped.

6. The combination as defined in claim 1, wherein each of the drag devices comprises: a drag plate pivotally mounted on each to the steering rudders and extended laterally therefrom during said projection thereof from the retracted position within the steering rudder by the actuator means.

7. The combination as defined in claim 1, wherein each of the drag devices comprises: a curved drag plate slidably displaced laterally from the retracted position within the steering rudder by the actuator means.

* * * * *